US008974892B2

(12) United States Patent
Nencioni et al.

(10) Patent No.: US 8,974,892 B2
(45) Date of Patent: Mar. 10, 2015

(54) MULTI-PLY PAPER PRODUCT OR THE LIKE, METHOD FOR THE PRODUCTION THEREOF AND RELATIVE SYSTEM

(75) Inventors: Giovanni Nencioni, Vecchiano (IT); Romano Maddaleni, Bientina (IT); Mauro Gelli, Lucca (IT)

(73) Assignee: Fabio Perini S.p.A., Lucca (IT)

( * ) Notice: Subject to any disclaimer, the term of this patent is extended or adjusted under 35 U.S.C. 154(b) by 847 days.

(21) Appl. No.: 10/591,392

(22) PCT Filed: Mar. 1, 2005

(86) PCT No.: PCT/IT2005/000114

§ 371 (c)(1),
(2), (4) Date: Sep. 1, 2006

(87) PCT Pub. No.: WO2005/085526

PCT Pub. Date: Sep. 15, 2005

(65) Prior Publication Data

US 2007/0184246 A1 Aug. 9, 2007

(30) Foreign Application Priority Data

Mar. 4, 2004 (IT) ..... FI2004A0053

(51) Int. Cl.
*B32B 3/26* (2006.01)
*D21H 27/02* (2006.01)
*D21H 27/30* (2006.01)

(52) U.S. Cl.
CPC ..... *D21H 27/02* (2013.01); *D21H 27/30* (2013.01)
USPC ..... 428/172; 428/156; 428/174; 156/209; 156/219; 156/290; 156/291; 156/292; 162/109; 162/362

(58) Field of Classification Search
None
See application file for complete search history.

(56) References Cited

U.S. PATENT DOCUMENTS

| | | | | |
|---|---|---|---|---|
| 2,502,111 | A | 3/1950 | Walker | |
| 4,543,142 | A * | 9/1985 | Kuepper et al. | 156/209 |
| 5,173,351 | A | 12/1992 | Ruppel et al. | |
| 5,382,464 | A | 1/1995 | Ruppel et al. | |
| 5,686,168 | A | 11/1997 | Laurent et al. | |
| 5,736,223 | A | 4/1998 | Laurent | |
| 5,840,404 | A | 11/1998 | Graff | |
| 6,106,928 | A * | 8/2000 | Laurent et al. | 428/152 |
| 6,221,211 | B1 * | 4/2001 | Hollenberg et al. | 162/123 |

(Continued)

FOREIGN PATENT DOCUMENTS

| | | | |
|---|---|---|---|
| EP | 0 408 248 | A2 | 1/1991 |
| EP | 0 408 248 | A3 | 11/1991 |

(Continued)

*Primary Examiner* — Frank D Ducheneaux
(74) *Attorney, Agent, or Firm* — Breiner & Breiner, L.L.C.

(57) ABSTRACT

A device is provided to produce an embossed multi-ply material, comprising: a first embossing-laminating unit (3) comprising a first embossing cylinder (5) equipped with first projections (5P) defining a first pattern, a first pressure roller (7) cooperating with said first embossing cylinder (5), a first laminating roller (9) and a first glue dispenser (11), disposed between said first pressure roller (7) and said first laminating roller (9); an embossing unit comprising at least a second embossing cylinder (25) provided with second projections (25P) defining a second pattern and a second pressure roller (27) cooperating with said second embossing cylinder (25); a first path (P1) through said first embossing-laminating unit (3); a second path (P2) for at least a second ply (V2) towards and through said second embossing unit (23); a third path (P3) for said third ply (V3).

20 Claims, 4 Drawing Sheets

(56) References Cited

U.S. PATENT DOCUMENTS

| | | | | |
|---|---|---|---|---|
| 6,287,676 | B1 * | 9/2001 | Ruppel et al. | 428/219 |
| 6,551,691 | B1 | 4/2003 | Hoeft et al. | |
| 6,589,634 | B2 | 7/2003 | Schultz et al. | |
| 6,599,614 | B1 * | 7/2003 | Roussel et al. | 428/172 |
| 6,755,928 | B1 * | 6/2004 | Biagiotti | 156/209 |
| 2003/0129363 | A1 * | 7/2003 | Hoeft et al. | 428/172 |
| 2005/0034828 | A1 * | 2/2005 | Graff et al. | 162/123 |

FOREIGN PATENT DOCUMENTS

| | | | |
|---|---|---|---|
| EP | 1 338 412 | A1 | 8/2003 |
| GB | 1 245 280 | | 9/1971 |
| WO | WO 99/44814 | A1 | 9/1991 |

* cited by examiner 1A
1B
1C
3
5
7
9
11
13
15
17
23
25
27
29
31
33
35
37
41
N
P1
P2
P3
V1
V2
V3
5P
15P
25P P1
P2
P3
P4
C1
N
V1
V2
V3
V1+V3
1
3
5
7
9
11
13
15
17
23
25
27
29
31
33
35
37
51
S1
S2

MULTI-PLY PAPER PRODUCT OR THE LIKE, METHOD FOR THE PRODUCTION THEREOF AND RELATIVE SYSTEM

FIELD OF INVENTION

The present invention relates to a web material, for example and in particular (although not exclusively) a product made of tissue paper, such as that used to produce toilet paper, kitchen towels, paper napkins, paper handkerchiefs or the like.

More specifically, the invention relates to a web material, such as a tissue paper product, of the multi-ply type, i.e. composed of several plies joined together by gluing, some of which decorated by embossing.

BACKGROUND OF THE INVENTION

The production of tissue paper articles often makes use of embossing processes to obtain both technical characteristics and a decoration on the finished product. Embossing is performed with various types of device comprising at least one embossing cylinder, equipped with a plurality of projections or protuberances distributed on the surface thereof, and cooperating with a pressure roller, usually provided with a yielding surface, for example made of rubber.

A web material with one or more plies are fed between the embossing cylinder and the pressure roller, and is deformed through the effect of the pressure with which the pressure roller and the embossing cylinder are pressed against each other. Deformation, which may be accompanied by at least partial breakage of the fibers composing the material, causes the formation of projections or protuberances on the web material. Several plies or layer of web material can be embossed separately and then joined by gluing, applying a glue to the protuberances of at least one of the plies and laminating the plies between two cylinders or rollers of the device. This is referred to as embossing and laminating and embossing and laminating devices. One or more smooth plies can also be joined by gluing and lamination to one or more embossed plies.

To obtain particular aesthetic and technical-functional characteristics articles with more than three plies joined to one another are produced. Multi-ply products of this type have high levels of strength, softness and absorption power.

WO-A-9944814 describes various methods and devices for the production of embossed and laminated articles. Some of these articles have more than two plies glued to one another. In an embodiment described therein (FIG. 3) a product with three plies is obtained, which are embossed on an embossing cylinder with which two pressure rollers cooperate. Two plies are fed between a first pressure roller and the embossing cylinder, and receive a glue on the protuberances, before a third ply is laid thereon. The three plies are subsequently embossed and laminated between the same embossing cylinder and a second pressure roller.

EP-A-408248 describes a device in which various embossing or laminating operations are performed on two plies. After having joined the two plies to each other, they are fed around an embossing cylinder with which two pressure rollers cooperate.

U.S. Pat. No. 6,589,634 describes a "tip-to-tip" embossing-laminating device, wherein two embossing cylinders each cooperate with a respective pressure roller to separately emboss two plies of paper. A glue is applied to the protuberances thereof by two glue dispensers each cooperating with one of the two embossing cylinders. The glued plies are laminated in a nip defined by the two embossing cylinders, into which a third ply is fed to obtain a three-ply product.

WO-A-9708386 describes a device to produce an article with two or more plies. In this device, an embossing cylinder cooperates with a first pressure roller to emboss a first sheet composed of two plies, on the protuberances of which a glue is applied. A second sheet is embossed between a second embossing cylinder and a respective pressure roller and subsequently fed to the first embossing cylinder, resting on the glued protuberances of the first sheet.

EP-A-1338412 describes a double embossing-laminating device, comprising a first tip-to-tip embossing and laminating unit, with two embossing cylinders and respective pressure rollers, and a second embossing unit, with a pressure roller and a laminating roller cooperating with a third embossing cylinder. A respective glue dispenser is associated with each embossing and laminating unit. This complex machine is designed to produce four-ply products.

U.S. Pat. No. 6,599,614 describes a tip-to-tip embossing and laminating device, wherein two embossing cylinders each cooperate with a respective pressure roller to, emboss two plies separately. These are then laminated together, with the interposition of a third ply, in the nip between the two embossing cylinders. Glue can be applied to the protuberances of the two embossed plies.

A similar device is described in, U.S. Pat. No. 5,736,223. This known device is provided with a gluing unit associated with each of the two embossing cylinders of the tip-to-tip unit. Moreover, the third intermediate ply, which is fed into the nip between the two embossing cylinders, is embossed separately between a third embossing cylinder and a third pressure roller.

U.S. Pat. No. 6,551,691 describes a device for producing a three-ply embossed web material. A first ply is embossed between a first embossing cylinder and a first pressure roller, while a second ply is embossed between a second embossing bossing cylinder and a second pressure roller. The plies thereby embossed are joined between the second embossing cylinder and a laminating roller, after insertion therebetween of a third ply. A glue is applied to the third, that is, central ply.

U.S. Pat. No. 5,382,464 describes an embossing and laminating device to produce a four-ply material, comprising four embossing cylinders and four pressure rollers. The embossing cylinders are phased to operate tip-to-tip. Two glue dispensers are provided to apply glue to the protuberances of two of the four plies, prior to reciprocal lamination.

The devices and methods described in the above documents are often complex and difficult to set up. Moreover, often they do not offer sufficient versatility, that is, they do not allow modifications to the type of article obtained.

SUMMARY OF THE INVENTION

The object of the invention is to produce a product which allows particular and ameliorative aesthetic and technical-functional effects to be obtained with respect to conventional products.

According to a different aspect, the object of the invention is to produce a method and a production line to obtain an innovative product.

Essentially, according to a first aspect, the invention relates to a multiply web material, comprising at least three plies joined to one another by gluing, wherein:

a first ply forming a first outer surface of said material has a first pattern composed of first decorative elements each formed of at least one protuberance projecting towards the inside of said material and obtained by embossing said first ply, said first decorative elements having a density of no more than 3 elements/$cm^2$;

a second ply forming a second outer surface of said material has a second pattern composed of second decorative elements each formed of at least one protuberance projecting towards the inside of said material and obtained by embossing said second ply, with a density of no more than 3 elements/$cm^2$;

at least a third ply is interposed between said first ply and said second ply;

at least a first glue is applied in areas corresponding to at least some of the protuberances defining said first decorative elements of the first ply;

and the first and the second decorative elements are different from each other.

In a possible embodiment, the first glue is applied to the third ply in areas corresponding to the protuberances forming the first decorative elements, or at least in some of these areas. The glue can be made to seep at least partly between the third and the first ply and used to reciprocally glue the third ply to the first ply as well as the third ply to the second ply.

In a different embodiment the material is provided with a second glue applied to the second ply at the level of at least some of the protuberances defining the second decorative elements.

When a first and a second glue are used, it is advantageous for said first glue to reciprocally glue the first and the third ply and said second glue to reciprocally glue said third and said second ply.

Advantageously, the first and the second decorative elements are distributed randomly with respect to each other.

According to a possible embodiment of the invention, the first ply has a background embossing. A similar background embossing can be provided on the second ply. This background embossing can be composed of protuberances with a geometrical form, of a height less than the protuberances forming said first decorative elements and with a higher density. Typically, the background embossing has a density of at least 8 protuberances/$cm^2$ and preferably equal to or greater than 15 protuberances/$cm^2$.

The background embossing of the second ply is preferably flattened at the level of the protuberances forming the first decorative elements on the first ply.

Some of the protuberances defining the second decorative elements can also be flattened at the level of the respective protuberances defining said first decorative elements, due to the fact that distribution of the decorative elements is random.

Preferably, the third ply is devoid of embossing, although it would be possible to use embossing also on the inner ply.

Each of the plies forming the material of the present invention can be composed of one, two or more layers joined to one another, for example, by ply-bonding.

According to another aspect, the invention relates to a method for the production of a multi-ply web material comprising the phases of:

embossing a first ply forming a first outer surface of said material forming thereon a first pattern composed of first decorative elements each formed by at least one protuberance projecting towards the inside of said material, said first elements having a density of no more than 3 elements/$cm^2$;

embossing a second ply forming a second outer surface of said material forming thereon a pattern composed of second decorative elements each formed by at least one protuberance projecting towards the inside of said material, said second elements having a density of no more than 3 elements/$cm^2$, the first and the second decorative elements differing from each other and being distributed randomly with respect to each other;

providing at least a third ply interposed between said first ply and said second ply;

applying at least a first glue in areas corresponding to at least some of the protuberances defining said first decorative elements.

According to yet another aspect, the invention relates to a device for the production of an embossed multi-ply material, comprising:

a first embossing-laminating unit comprising a first embossing cylinder equipped with first projections defining a first pattern, a first pressure roller cooperating with said first embossing cylinder, a first laminating roller and a first glue dispenser disposed between said first pressure roller and said first laminating roller;

an embossing unit comprising at least a second embossing cylinder equipped with second projections defining a second pattern and a second pressure roller cooperating with said second embossing cylinder;

a first path for at least a first ply towards and through said first embossing-laminating unit;

a second path for at least a second ply towards and through said second embossing unit;

a third path for said third ply.

The embossing unit may advantageously be a second embossing-laminating unit and comprise: a second laminating roller cooperating with said second embossing cylinder; and a second glue dispenser disposed between said second pressure roller and said second laminating roller.

Further advantageous characteristics and embodiments of the method, of the product and of the device according to the present invention are indicated in the appended claims.

BRIEF DESCRIPTION OF THE DRAWINGS

The invention shall be better understood by following the description and accompanying drawing, which shows non-limiting practical embodiments of the invention. More specifically, in the drawing.

DETAILED DESCRIPTION OF THE PREFERRED EMBODIMENTS

Figures 1, 1A, 1B, 1C:
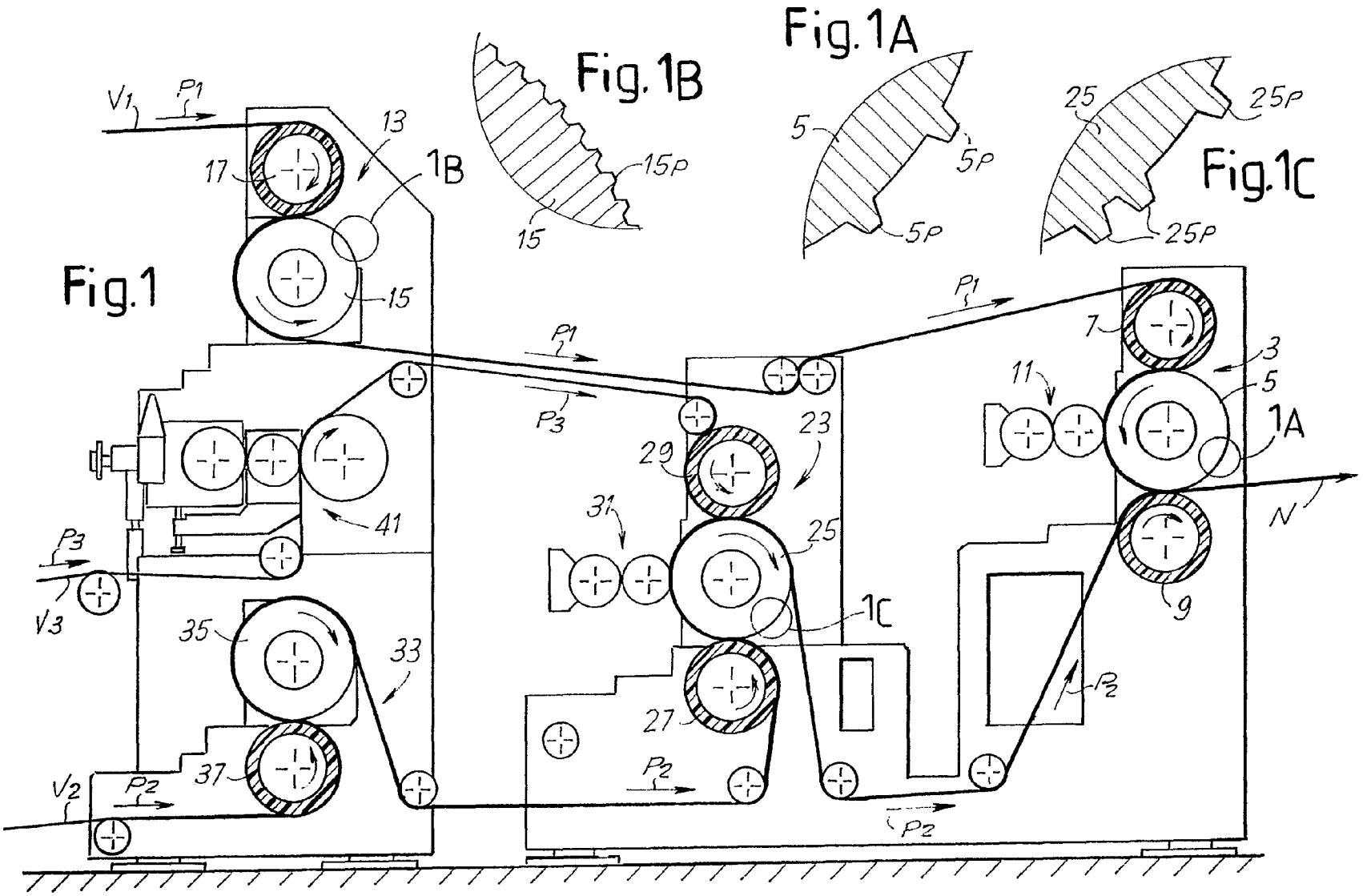
FIGS. 1 and 2 show schematic side views of two production lines according to the invention.
FIGS. 1A, 1B and 1C show schematic enlargements of the details IA, IB and IC in FIG. 1.

FIG. 1 schematically shows a portion of a first line to produce a web material according to the invention. The line, indicated as a whole with 1, comprises a first embossing-laminating unit 3 with a first embossing cylinder 5, made of steel or another relatively hard material, provided on the surface of which are projections or protuberances 5P, the form of which corresponds to the embossing pattern to be produced on the web material with the embossing-laminating unit 3.

The embossing cylinder 5 cooperates with a first pressure roller 7, coated in a yielding material, such as rubber or the like. Moreover, disposed along the extension of the embossing cylinder 5 is a first laminating roller 9, which may be coated in a yielding material, although preferably harder than the material coating the pressure roller 7.

Disposed between the two rollers 7 and 9 is a first glue dispenser 11, which applies a glue to at least some of the protuberances produced by the projections 5P of the embossing cylinder 5 in a first ply V1 fed towards and through the embossing-laminating unit 3 along a first path P1.

Disposed along the path P1 is a first secondary embossing unit 13 which in the example shown comprises an embossing cylinder 15 and a pressure roller 17 coated in a yielding material. It would also be possible for the secondary embossing unit 13 to be produced differently, for example with a pressure roller made of steel or, in any case, with a hard surface, provided with cavities corresponding to the projections 15P (FIG. 1B) of the cylinder 15.

Disposed upstream of the first embossing-laminating unit 3 is a second embossing laminating unit 23, comprising a second embossing cylinder 25, provided with projections 25P (FIG. 1C) similar to the projections 5P of the embossing cylinder 5. As represented schematically in FIGS. 1A and 1C, the projections 5P and 25P are of different forms and/or dimensions from each other, to form on respective embossed plies, embossing patterns different from each other.

Disposed around the embossing cylinder 25 are a second pressure roller 27, similar to the roller 7, a second laminating roller 29, similar to the roller 9 and a second glue dispenser 31, similar to the dispenser 11.

A second ply V2 is fed to the second embossing-laminating unit 23 along a second path P2 towards and through said embossing-laminating unit. The path P2 continues beyond the embossing-laminating unit 23 to the embossing laminating unit 3.

Disposed along the path P2 is a second secondary embossing unit 33 comprising an embossing cylinder 35 similar to the cylinder 15 and a pressure roller 37 similar to the roller 17. The protuberances of the embossing cylinder 35 can be the same or different, in form, dimension and/or density, with respect to the protuberances of the cylinder 15. In general, the protuberances of the two cylinders 15 and 35 have a geometrical form, for example a truncated pyramidal form, distributed according to a simple geometrical pattern and with high densities, typically more than 8 projections/$cm^2$, preferable more than 15 projections/$cm^2$ and even more preferably equal to or more than 30 projections/$cm^2$.

On the other hand, the projections 5P and 25P of the embossing cylinders 5 and 25 are complex in form and respectively define first and second decorative elements composed of aesthetic designs or patterns differing from each other. Each decorative element produced by one or by the other of the two embossing cylinders 5 and 25 can be produced by a single projection 5P or 25P, or by a group of projections combined with one another, as shall be clarified in greater detail hereunder with reference to a specific embodiment.

In addition to the first and to the second path P1 and P2 for the two plies V1 and V2, the production line has a third path P3 for a third ply V3. The path P3 extends towards the second embossing-laminating unit 23 and disposed therealong (in the example shown in FIG. 1) is a printing unit 41 of a type known and not described in greater detail, which prints a pattern on the third ply V3. In the example shown the printing unit 41 is monochromatic, although it would also be possible to use a printing unit with more than one color and/or more than one printing unit in series.

The system described above with reference to FIG. 1 operates as follows. The ply V1 is subjected to background embossing, which may be micro-embossing, by the secondary embossing unit 13. The ply V1 thus embossed is fed along the path P1 to the embossing-laminating unit 3 where it is embossed a second time in the nip between the embossing cylinder 5 and the pressure roller 7, to form thereon protuberances corresponding to the projections 5P of the embossing cylinder 5. The protuberances will be facing the in side of the finished multi-ply web material. The micro-embossing protuberances, produced by the projections 15P, will be flattened at the level of the projections 5P.

While the ply V1 is still engaged with the projections 5P of the embossing cylinder 5, it is provided with a first glue applied, by the glue dispenser 11, to the projecting surfaces of at least some of the protuberances, that is, corresponding responding to the front surfaces of at least some of the projections 5P.

After application of the glue, the embossed ply V1 is laminated in the nip between the embossing cylinder 5 and the laminating roller 9. The plies V2 and V3 advancing along the second path P2 from the second embossing-laminating unit 23 are also fed into this nip. In this way, the group of plies V2, V3 is glued to the ply V1 through the effect of the glue applied by the dispenser 11 and of the pressure in the lamination nip between the roller 9 and the cylinder 5.

The second ply V2 is fed along the path P2 through the second secondary embossing unit 33, where it is subjected to background embossing or micro-embossing to form protuberances. Subsequently, this ply V2 is embossed between the embossing cylinder 25 and the pressure roller 27 to obtain thereon an embossing pattern formed by protuberances (which in the finished product will be facing the inside) formed by the projections 25P of the embossing cylinder 25. Just as for the protuberances formed by the projections 5P on the ply V1, glue is applied to at least some of the protuberances formed by the projections 25P on the ply V2 by means of the glue dispenser 31. The ply thus provided with glue and still engaged with the projections 25P is laminated between the laminating roller 29 and the embossing cylinder 25 together with the third ply V3 coming from the path P3 and, optionally, printed in the printing unit 41.

A semi-finished product composed of the two plies V2 and V3 already joined by gluing is thus delivered from the embossing-laminating unit 23 to the second part of the path P2 between the second and first embossing-laminating unit.

In the lamination nip between the laminating roller 9 and the embossing cylinder 5 of the embossing-laminating unit 3, the three plies V1, V2 and V3 are laminated together and the projections 5P will flatten the protuberances defining the background embossing of the ply V2, formed by the auxiliary embossing unit 33. In general, the protuberances defining the decorative pattern formed by the projections 25P on the ply V2 will be staggered and disposed essentially randomly between the protuberances formed by the projections 5P on the ply V1, so that the decorative elements produced by the projections 25P will not be damaged in the second lamination to which the ply V2 is subjected in the embossing-laminating unit 3.

Figure 3:
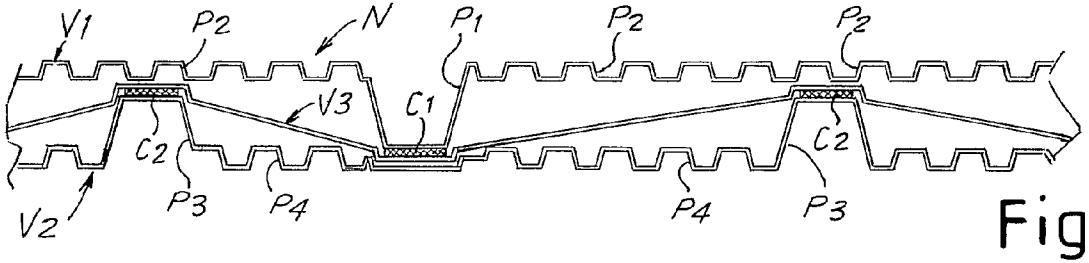
FIG. 3 shows a schematic and greatly enlarged cross section of a product according to the invention.

FIG. 3 shows a very schematic greatly enlarged cross-section of the product N delivered from the first embossing-laminating unit 3. The two plies V1 and V2 form the opposed outer surfaces of the web material N, and disposed therebetween is the ply V3. The protuberances P1 formed by the projections 5P of the first embossing-lamininating unit 3, are produced on the ply V1. On the surface devoid of these protuberances P1 the ply V1 has a background pattern formed by the small protuberances P2 produced by the secondary embossing unit 13. These protuberances P2 defining the background micro-embossing are flattened in the areas of the surface affected by the protuberances P1.

The inner ply V3 is lightly embossed at the protuberances P1 due to the effect of lamination of the laminating roller 9 against the embossing cylinder 5. In this area the first glue C1 applied by the dispenser 11 on the front surface of the protuberances P1 produced on the ply V1 joins the plies V1 and V3. The depth with which the ply V3 is embossed depends on the lamination pressure and/or on the degree of yield of the laminating roller 9. Preferably, the material forming the outer cylindrical surface of the laminating roller 9 is sufficiently rigid to cause very limited embossing or deformation of the ply V3.

The ply V2 has protuberances P3 defining a decorative design, which—similar to the protuberances P1 on the ply V1—are facing the inside of the web material N. On the surface not affected by the protuberances P3, the ply V2 has micro-embossing or background embossing composed of the protuberances P4 produced by the secondary embossing unit 33.

The ply V2 is joined to the inner ply V3 by a glue C2 applied by the glue dispenser 31 to the front surfaces of the protuberances P3. As joining of the plies V2 and V3 takes place by lamination between the embossing cylinder 25 and the laminating roller 29, the ply V3 is lightly embossed at the protuberances P3. The depth of the deformation of this inner ply varies according to the lamination pressure and to the rigidity of the surface of the laminating roller 29.

As can be seen in FIG. 3, the protuberances P1 and the protuberances P3 are disposed randomly and staggered with respect to each other. In the lamination area between the embossing cylinder 5 and the laminating roller 9 the background protuberances P4 provided on the ply V2 are flattened. For reasons analogous to those determining deformation of the inner ply V3 in this area, the outer ply V2 may also be lightly deformed beyond the original plane thereof.

The glues C1 and C2 may be colorless, colored and of one color, or colored and of different colors, or different shades of the same color to provide the finished product with a further decorative effect. This can be added or combined to a chromatic effect obtained through printing of the inner ply V3.

The web material N thus obtained can be used to form rolls of toilet paper or other similar products. Production of different embossing designs on the two opposed faces of the material makes it possible to obtain a particular aesthetic effect, as can be seen in particular in FIGS. 4 and 5. These two figures show a roll R of wound web material. The ply V1 forms the outer surface of the roll, while the ply V2 forms the inner surface of each turn. A first decorative pattern composed of a series of first decorative elements, each indicated with E1 and each represented (in this example) by a sun, is reproduced on the outer ply V1. Each decorative element E1 is formed by a complex group of protuberances P1 defining the rays and the central part of the sun. The ply V2 facing the inside of the roll is provided with a second decorative pattern composed of a series of second decorative elements each indicated with E2 and represented (in the example shown) by clouds. In this case each decorative element E2 is composed of a single protuberance P3.

The decorative elements E1 and E2 are disposed in an entirely random fashion with respect to each other and, as represented also in FIG. 3, the decorative elements of one ply are normally disposed intercalated between the decorative elements of the other ply.

Figure 5:
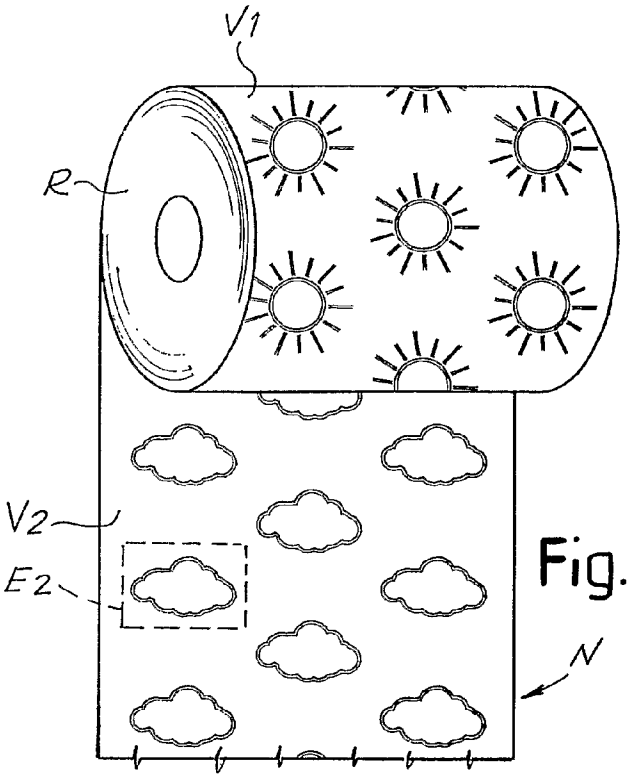
FIGS. 4 and 5 show schematic perspective views of a roll of wound product, according to two different angles.
Figure 4:
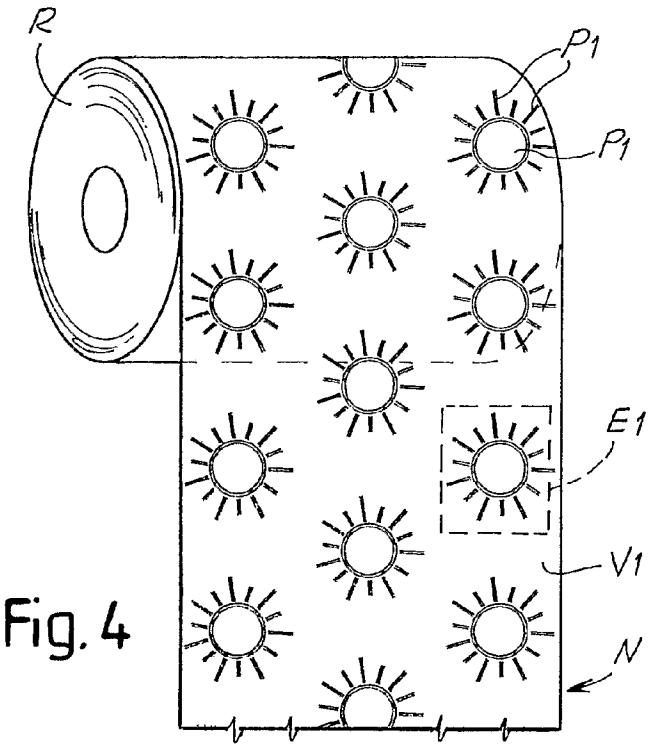

In FIGS. 4 and 5 the background embossing provided on the two outer plies V1 and V2 has been omitted for clarity of the drawing.

The decorative elements E1 are of a form which makes them symmetrical with respect to a straight line parallel to the axis of the roll. In this way the decorative pattern has a meaning for those observing it, irrespective of the position in which the roll is placed for use.

Figure 2:
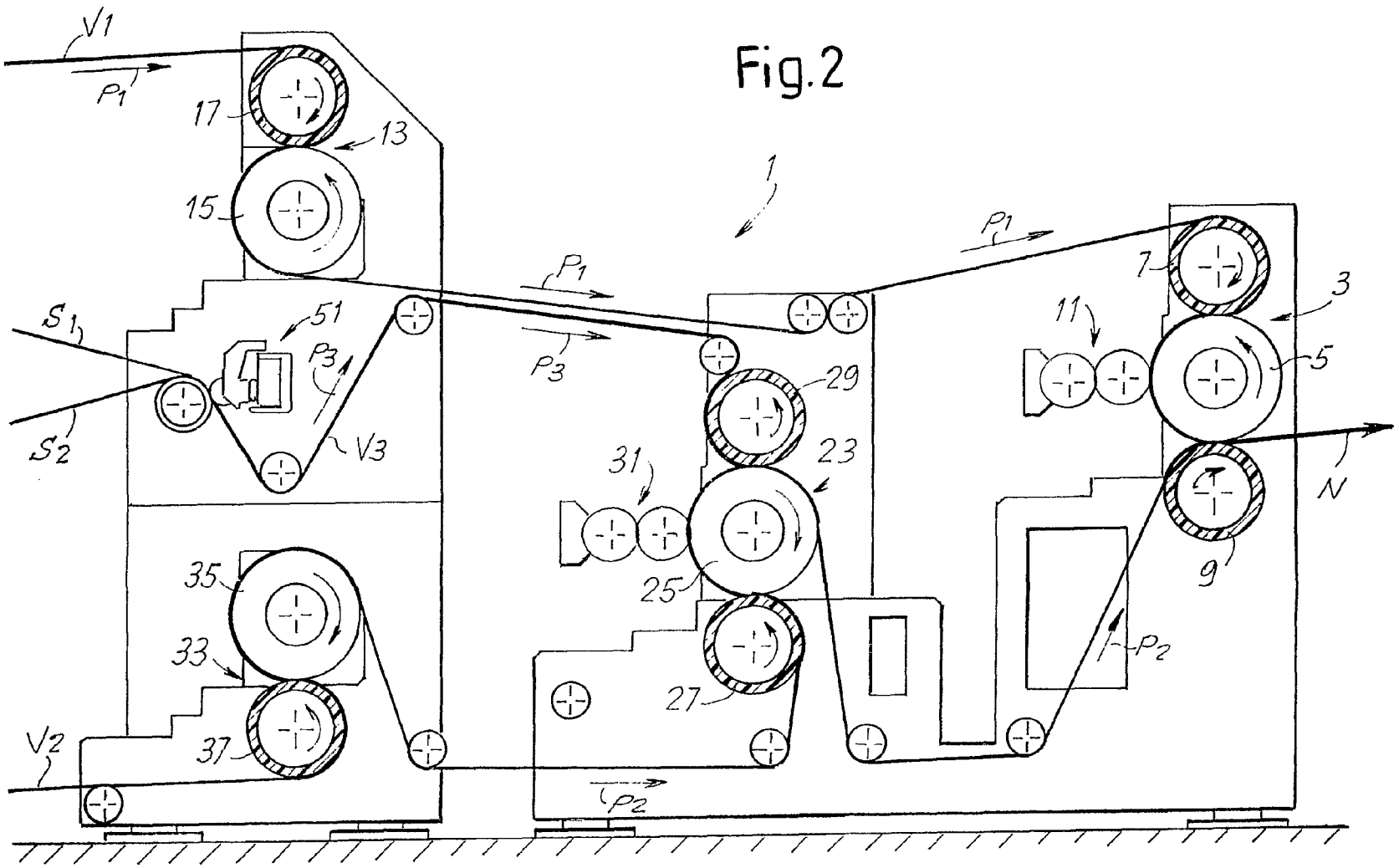

FIG. 2 schematically shows a different configuration of the production line. The same or equivalent parts to those shown in FIG. 1 are indicated with the same reference numbers. In the example in FIG. 2 the printing unit 41 has been omitted, while a ply-bonding unit 51 is provided to join together the two layers S1, S2 of paper material destined to form the inner ply V3. In fact, the various plies V1, V2 and V3 can each be composed of one or more layers. The individual layers forming each ply can be joined to each other by embossing, ply-bonding (as shown in the example), gluing or the like. Advantageously, the inner ply will be composed of more than one layer, especially when colored glues of different colors are used. A greater thickness of the inner ply and/or the use of a colored inner ply in fact allow better optical separation of the opposed outer surfaces of the finished product.

Figures 6, 7:
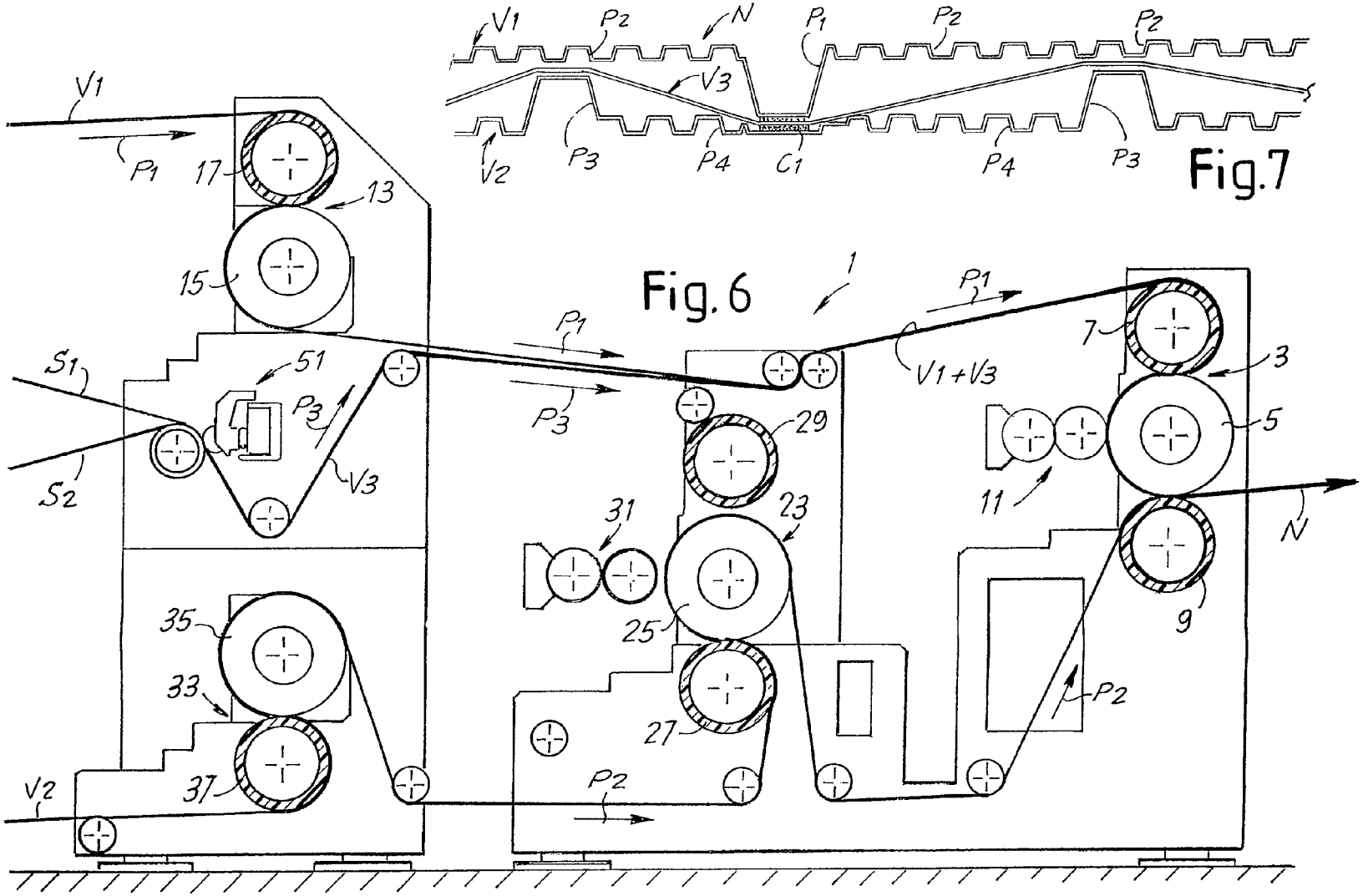
FIG. 6 shows a schematic side view of a production line analogous to the line in FIG. 2, in a different layout.
FIG. 7 shows a schematic and greatly enlarged section of the product obtained with the line in FIG. 6.

FIG. 6 shows a schematic side view of a production line essentially identical to the line in FIG. 2, but in a slightly different layout. The same numbers indicate the same or equivalent parts in the two figures.

In the layout in FIG. 6, the ply V3 is not fed to the second embossing-laminating unit 23, but is placed directly adjacent to the ply V1 and fed together therewith to the first embossing-laminating unit 3, between the embossing cylinder 5 and the pressure roller 7. On the other hand, only the ply V2 is fed to the embossing-laminating unit 23 and in view of this, the glue dispenser unit 31 and the laminating roller 29 are taken to the idle position, wherein they do not interact with the surface of the embossing cylinder 25. In this layout the embossing-laminating unit, 23 functions as a simple steel-rubber embossing unit, in which a single ply V2 is fed between the embossing cylinder 25 and the pressure roller 27 and subjected solely to embossing, without being joined to another ply by gluing.

The product obtained is represented schematically in the section in FIG. 7, where the same numbers represent parts the same or equivalent to those in FIG. 3. The glue C1 is in this case applied in the areas of the ply V3 corresponding to at least some of the projections 5P of the embossing cylinder 5, due to the fact that the ply V3 is outside the ply V1 when the two plies are fed around the embossing cylinder 5. Downstream of the glue dispenser 11 the ply V2 is laminated together with the ply V3 and the ply V1 between the embossing cylinder 5 and the pressure roller 9. Here, thanks to the pressure exerted on the plies and on the glue C1, part of the glue C1 seeps through the ply V3 towards the ply V1 reciprocally bonds them.

It is understood, from the description with reference to FIG. 6 and previously with reference to FIG. 2, that the production line obtained as illustrated in these figures can operate to produce an article as in FIG. 3 or as in FIG. 7 alternatively. It is also understood that with an analogous adjustment in the path of the plies and in the layout of the members of the embossing-laminating unit 23, the line in FIG. 1 can also operate in the same way as described with reference to FIG. 6.

Moreover, it will be understood that by relinquishing the possibility of the double operating mode, it is possible to produce a production line analogous to those illustrated in FIG. 1, 2 or 6, wherein the embossing-laminating unit 23 is replaced by a simple embossing unit with only the embossing cylinder 25 provided with decorative projections 25P and with the pressure roller 27. This line can only be used to obtain the product in FIG. 7 and not the one in FIG. 3.

The patterns on one or other of both the faces of the product can be patterned designs or even trademarks, distinctive marks, logos or the like, optionally intercalated with patterned designs or even with inscriptions of various kinds.

It is understood that the drawing merely shows possible embodiments of the invention, which may vary in forms and arrangements without however departing from the scope of the concept on which the finding is based. Any reference numerals in the appended claims are provided purely to facilitate reading thereof in the light of the preceding description and of the accompanying drawings, and do not limit the scope of protection whatsoever.

The invention claimed is:

1. A multi-ply web material comprising at least three plies joined to one another by adhesive, wherein:

a first ply forming a first outer surface of said web material has a first pattern composed of a plurality of first decorative elements, each of said first decorative elements providing an image in itself and is formed of at least one protuberance projecting inward of said web material and obtained by embossing said first ply, said first decorative elements having a density of no more than 3 elements/$cm^2$;

a second ply forming a second outer surface of said web material has a second pattern composed of a plurality of second decorative elements, each of said second decorative elements providing an image in itself and is formed of at least one protuberance projecting inward of said web material and obtained by embossing said second ply, said second decorative elements having a density of no more than 3 elements/$cm^2$;

at least a third ply is interposed between said first ply and said second ply;

at least a first adhesive is applied between the first ply and the third ply in areas corresponding to at least some of the protuberances defining said first decorative elements of the first ply;

the first decorative elements and the second decorative elements are different from each other and are distributed with respect to each other so that the decorative elements of one of the first ply or the second ply are intercalated between the decorative elements of the other of the first ply or the second ply so that the first pattern appears on the first outer surface and not on the second outer surface, and the second pattern appears on the second outer surface and not on the first outer surface;

at least a second adhesive, which is chromatically different from the first adhesive, is applied between the second ply and the third ply in areas corresponding to at least some of the protuberances defining said second decorative elements of the second ply;

the first ply and the third ply are adhesive-bonded together at least at said areas where said first adhesive is applied, wherein areas in said second ply corresponding to said areas in the first ply are devoid of any protuberance or have a flattened protuberance; and the second ply and the third ply are adhesive-bonded together at least at said areas where said second adhesive is applied.

2. The web material as claimed in claim 1, wherein said first adhesive is applied to the third ply in at least some areas corresponding to said at least some of the protuberances defining the first decorative elements.

3. The web material as claimed in claim 2, wherein said first adhesive is made to seep at least partly through said third ply and adheres said third ply to said second ply.

4. The web material as claimed in claim 1, wherein said first ply has a background pattern.

5. The web material as claimed in claim 4, wherein the background pattern of said first ply is composed of protuberances of a height less than a height of the protuberances forming said first decorative elements.

6. The web material as claimed in claim 4, wherein said background pattern of the first ply has a density equal to or greater than 8 protuberances/$cm^2$.

7. The web material as claimed in claim 1, wherein said second ply has a background pattern.

8. The web material as claimed in claim 7, wherein the background pattern of said second ply is composed of protuberances with a geometrical form, said second protuberances having a height less than the height of the protuberances forming said second decorative elements.

9. The web material as claimed in claim 8, wherein said background pattern of the second ply has a density equal to or greater than 8 protuberances/$cm^2$.

10. The web material as claimed in claim 8, wherein said background pattern of the second ply is flattened in areas corresponding to at least the protuberances forming the first decorative elements on said first ply.

11. The web material as claimed in claim 1, wherein at least some of the protuberances defining said second decorative elements are flattened in areas corresponding to respective protuberances defining said first decorative elements.

12. The web material as claimed in claim 1, wherein said third ply is colored.

13. The web material as claimed in claim 1, wherein said third ply has a printed pattern.

14. The web material as claimed in claim 1, wherein one or more of said first ply, said second ply and said third ply are composed of two or more layers.

15. The web material as claimed in claim 14, wherein said two or more layers are joined to one another by mechanical ply-bonding.

16. The web material as claimed in claim 14, wherein at least said third ply is composed of two or more layers.

17. The web material as claimed in claim 1, wherein said at least one third ply is adhered to the second ply by lamination at the protuberances forming said second decorative elements.

18. The web material as claimed in claim 1, wherein said web material is wound in a manner to form a roll.

19. The web material as claimed in claim 18, wherein at least the first pattern of the first outer surface of the web material on the roll is composed of decorative elements positioned symmetrically to a straight line parallel to a longitudinal axis of the roll.

20. A multi-ply web material comprising at least three plies joined to one another by adhesive, wherein:

a first ply forming a first outer surface of said web material has a first pattern composed of a plurality of first decorative elements, each of said first decorative elements providing an image in itself and is formed of at least one protuberance projecting inward of said web material and obtained by embossing said first ply, said first decorative elements having a density of no more than 3 elements/$cm^2$;

a second ply forming a second outer surface of said web material has a second pattern composed of a plurality of second decorative elements, each of said second decorative elements providing an image in itself and is formed of at least one protuberance projecting inward of said web material and obtained by embossing said second ply, said second decorative elements having a density of no more than 3 elements/$cm^2$;

at least a third ply is interposed between said first ply and said second ply;

at least a first adhesive is applied between the first ply and the third ply first areas corresponding to at least some of the protuberances defining said first decorative elements of the first ply, and at least a second adhesive is applied between the second ply and the third ply second areas corresponding to at least some of the protuberances defining said second decorative elements of the second ply, said first areas and said second areas being staggered to one another and said first adhesive is chromatically different from said second adhesive;

said third ply is bonded at said first areas to said first ply and at said second areas to said second ply which are staggered with respect to each other;

the first decorative elements and the second decorative elements are different in shape from each other; and in areas on the second ply corresponding to said first decorative elements on the first ply, the second ply is devoid of said second decorative elements or said second decorative elements thereat are flattened so that the first pattern appears on the first outer surface and not on the second outer surface, and the second pattern appears on the second outer surface and not on the first outer surface.

* * * * *

UNITED STATES PATENT AND TRADEMARK OFFICE

CERTIFICATE OF CORRECTION

PATENT NO. : 8,974,892 B2
APPLICATION NO. : 10/591392
DATED : March 10, 2015
INVENTOR(S) : Giovanni Nencioni, Romano Maddaleni and Mauro Gelli It is certified that error appears in the above-identified patent and that said Letters Patent is hereby corrected as shown below:

TITLE PAGE IN THE ABSTRACT (57):

Line 12, after "path (P1)", insert -- for at least a first ply (VI) towards and --.

IN THE CLAIMS:

Column 11, claim 20, line 10, after "third ply" insert -- in --.

Column 11, claim 20, line 13, after "third ply" insert -- in --.

Signed and Sealed this
Twenty-fourth Day of November, 2015

Michelle K. Lee

Michelle K. Lee
*Director of the United States Patent and Trademark Office*